US005979717A

United States Patent [19]

Dalton et al.

[11] Patent Number: 5,979,717

[45] Date of Patent: Nov. 9, 1999

[54] DISPENSING MECHANISM WITH FLOW REGULATOR

[75] Inventors: David Andrew Dalton, Cincinnati, Ohio; Eric Francis Henry, Rutherford, N.J.

[73] Assignee: The Procter & Gamble Company, Cincinnati, Ohio

[21] Appl. No.: 08/939,798

[22] Filed: Sep. 29, 1997

[51] Int. Cl.[6] ..... B67D 3/00

[52] U.S. Cl. ..... 222/532; 222/533; 222/536; 222/526

[58] Field of Search ..... 222/532, 533, 222/536, 537, 561, 545, 145.1

[56] References Cited

U.S. PATENT DOCUMENTS

| | | | |
|---|---|---|---|
| 1,368,270 | 2/1921 | Lissman | 222/536 |
| 1,419,338 | 6/1922 | Wieneke | 222/561 |
| 2,649,225 | 8/1953 | Jobson | 222/545 |
| 4,113,150 | 9/1978 | Ostergaard | 222/243 |
| 4,143,432 | 3/1979 | Deken | 4/295 |

(List continued on next page.)

FOREIGN PATENT DOCUMENTS

| | | | |
|---|---|---|---|
| 1101378 | 5/1981 | Canada | 221/27 |
| 0 736279 A1 | 10/1996 | European Pat. Off. | A47F 1/035 |
| 2591201 | 6/1987 | France | B65D 83/06 |
| 2716872 | 9/1995 | France | B65D 83/00 |
| 2725118 | 4/1996 | France | A47F 3/024 |
| 2525426 A1 | 12/1976 | Germany | A47J 42/08 |
| 2619990 A1 | 11/1977 | Germany | B65D 47/06 |
| 2921186 A1 | 11/1980 | Germany | B65D 83/04 |
| 3343118 A1 | 6/1984 | Germany | A47J 42/40 |
| 3510360 A1 | 11/1985 | Germany | B65D 83/04 |
| 3809548 A1 | 10/1989 | Germany | A47J 31/40 |
| 19522360 | 8/1996 | Germany | B65D 83/06 |
| 1488372 | 10/1977 | United Kingdom | G01F 11/24 |
| WO 82/01992 | 6/1982 | WIPO | A61J 1/00 |
| WO 95/00102 | 1/1995 | WIPO | A61J 7/04 |
| WO 96/33128 | 10/1996 | WIPO | B67D 5/08 |

*Primary Examiner*—Andres Kashnikow
*Assistant Examiner*—David Deal
*Attorney, Agent, or Firm*—Rodney M. Young

[57] ABSTRACT

A flow regulator for controlling the flow of material from a container is disclosed, wherein the container includes a container outlet through which the material freely flows when the container outlet is not closed. The flow regulator includes a material passageway having an inlet. The inlet of the material passageway is moved relative to the container between a first position where the inlet of the material passageway is not aligned with the container outlet to prevent the free flow of material between the container and the material passageway and a second position where the inlet of the material passageway is aligned with the container outlet to permit the flow of material between the container and the material passageway. The regulator also includes a regulating flap, configured to substantially cover the container outlet, coupled between the container outlet and the inlet of the material passageway. The regulating flap is moved between a closed position where the flow of material from the container outlet is prevented when the container outlet and the inlet of the material passageway are out of alignment and an open position where the flow of material from the container outlet is permitted when the container outlet and the inlet of the material passageway are substantially aligned. In use, movement of the material passageway relative to the regulating flap controls actuation of the regulating flap between an open and a closed position.

18 Claims, 4 Drawing Sheets

U.S. PATENT DOCUMENTS

| | | | |
|---|---|---|---|
| 4,176,767 | 12/1979 | Franche, IV | 222/243 |
| 4,241,855 | 12/1980 | Yoshioka | 222/479 |
| 4,349,128 | 9/1982 | Sanfilippo | 222/166 |
| 4,384,662 | 5/1983 | Boudin et al. | 222/484 |
| 4,557,404 | 12/1985 | Solomon | 222/325 |
| 4,561,572 | 12/1985 | Grundler | 222/410 |
| 4,562,941 | 1/1986 | Sanfilippo | 222/108 |
| 4,572,376 | 2/1986 | Wrennall | 206/538 |
| 4,776,493 | 10/1988 | Tegel | 222/196 |
| 4,854,478 | 8/1989 | Gyimothy | 221/190 |
| 4,856,681 | 8/1989 | Murray | 222/158 |
| 4,969,586 | 11/1990 | Ostroski | 222/545 |
| 4,997,112 | 3/1991 | Eichler | 222/530 |
| 5,105,991 | 4/1992 | Johnson | 222/185 |
| 5,125,542 | 6/1992 | Blanc | 222/181 |
| 5,144,963 | 9/1992 | Dabringhaus et al. | 131/231 |
| 5,219,100 | 6/1993 | Beck et al. | 222/480 |
| 5,284,264 | 2/1994 | Gross | 215/237 |
| 5,361,937 | 11/1994 | Wiese | 221/189 |
| 5,385,267 | 1/1995 | Diamond et al. | 221/248 |
| 5,437,393 | 8/1995 | Blicher et al. | 222/77 |
| 5,458,295 | 10/1995 | Haber et al. | 241/100 |
| 5,477,981 | 12/1995 | Heyl et al. | 221/86 |
| 5,542,583 | 8/1996 | Bovyer et al. | 222/425 |
| 5,560,519 | 10/1996 | Moore et al. | 222/129 |
| 5,730,333 | 3/1998 | Baluk et al. | 222/181.3 |

DISPENSING MECHANISM WITH FLOW REGULATOR

FIELD OF THE INVENTION

The invention relates to a flow regulator for controlling the flow of material from a container. The invention also relates to a dispensing mechanism employing a flow regulator for controlling the flow of material from a container.

BACKGROUND OF THE INVENTION

Self serve dispensers have become a common sight in grocery stores throughout the country. These dispensers allow consumers to purchase any quantity of a product by simply retrieving the product from the dispenser in any desired quantity. In this way, consumers are not limited by prepackaged products, manufacturers need not prepackage their goods for purchase by the consumer, and grocery stores are able to stock more product in limited spaces.

These dispensers are generally used for distributing loose bulk items, which the consumer places in a bag or collection device provided adjacent the dispenser. The dispensers have found wide acceptance in the distribution of coffee, grains, candy, rice, beans, nuts, bolts, nails and other products that are easily distributed in loose form.

Among the most common dispensers currently employed in grocery stores is the upright dispenser which relies upon the force of gravity to dispense a product through a nozzle that is selectively opened and closed by a consumer. In use, the consumer generally places a bag beneath a nozzle outlet and opens the nozzle to release the items stored within the container of the dispenser. Once the nozzle is opened, the product freely flows out of the container, through the nozzle and into the bag placed below the nozzle.

One problem with nozzles employed in such dispensers is that they generally rely upon a single barrier to control the flow of product from the container. When these barriers are moved even slightly, the container outlet of the dispenser is opened and product begins to freely flow from container. Even slight movements of the barrier are often enough to cause the product to freely flow, thus product can end up on the floor of the store because the consumer may be unprepared for the immediate product flow. Even when consumers intentionally move the barrier, they often do not expect such slight movement of the barrier to release the free flow of product. When this occurs, the consumer either overfills his or her bag, or inadvertently spills some of the goods flowing from the dispenser.

As such, a need exits for a dispenser capable of distributing loose items, while also providing a substantial amount of control to the consumer gathering the product from the dispenser. The present invention provides a flow regulator and dispensing system which provides such control to consumers.

SUMMARY OF THE INVENTION

It is, therefore, an object of the present invention to provide a flow regulator for controlling the flow of material from a container, wherein the container includes a container outlet through which the material freely flows when the container outlet is not closed. The flow regulator includes a material passageway having an inlet. The inlet of the material passageway is moved relative to the container between a first position where the inlet of the material passageway is not aligned with the container outlet to prevent the free flow of material between the container and the material passageway and a second position where the inlet of the material passageway is aligned with the container outlet to permit the flow of material between the container and the material passageway. The regulator also includes a regulating flap, configured to substantially cover the container outlet, coupled between the container outlet and the inlet of the material passageway. The regulating flap is moved between a closed position where the flow of material from the container outlet is prevented when the container outlet and the inlet of the material passageway are out of alignment and an open position where the flow of material from the container outlet is permitted when the container outlet and the inlet of the material passageway are substantially aligned. In use, movement of the material passageway relative to the regulating flap controls actuation of the regulating flap between an open and a closed position.

It is also an object of the present invention to provide a flow regulator wherein the material passageway includes a biasing member which restrains the regulating flap in its closed position when the container outlet is out of alignment with the inlet of the materials passageway and releases the regulating flap when the inlet of the material passageway is substantially aligned with the container outlet.

It is another object of the present invention to provide a dispensing mechanism for the controlled dispensing of material stored within a container. The mechanism includes a nozzle adapted for attachment to a container adjacent a container outlet. The nozzle includes a nozzle inlet into which the material from the container can flow and a nozzle outlet through which material entering the nozzle can exit. The mechanism also includes a nozzle bracket for mounting the nozzle adjacent the container outlet, wherein the nozzle bracket supports the nozzle such that the nozzle can be moved along the outer surface contour of the container between a first position in which the nozzle inlet is not aligned with the container outlet and a second position in which the nozzle inlet is aligned with the container outlet.

Other objects and advantages of the present invention will become apparent from the following detailed description when viewed in conjunction with the accompanying drawings, which set forth certain embodiments of the invention.

DETAILED DESCRIPTION OF THE INVENTION

Figure 1:
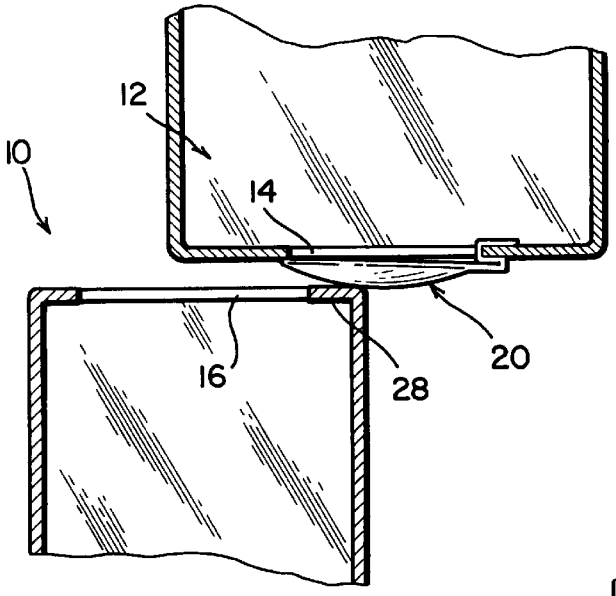
FIG. 1 is a cross sectional view of the present flow regulator in a fully closed position.
Figure 2:
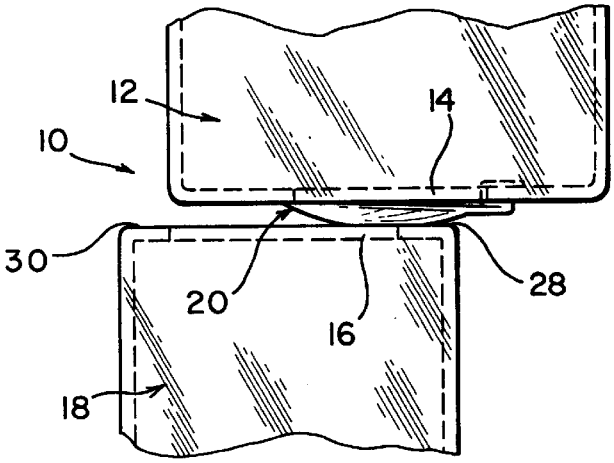
FIG. 2 is a cross sectional view of the present flow regulator with the container outlet and the inlet of the material passageway partially aligned.
Figure 3:
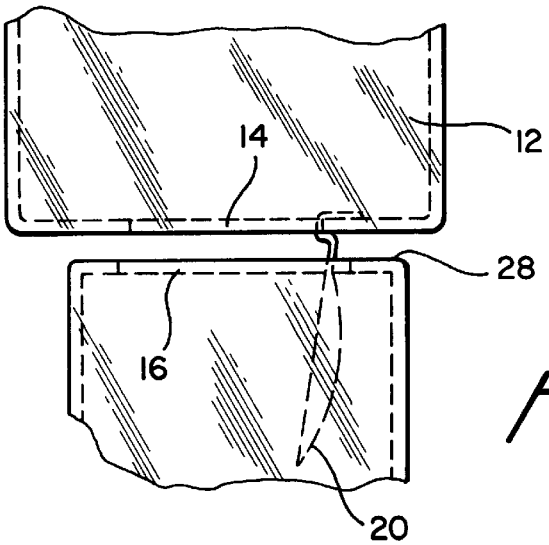
FIG. 3 is a cross section view of the present flow regulator in an open position.
Figure 5:
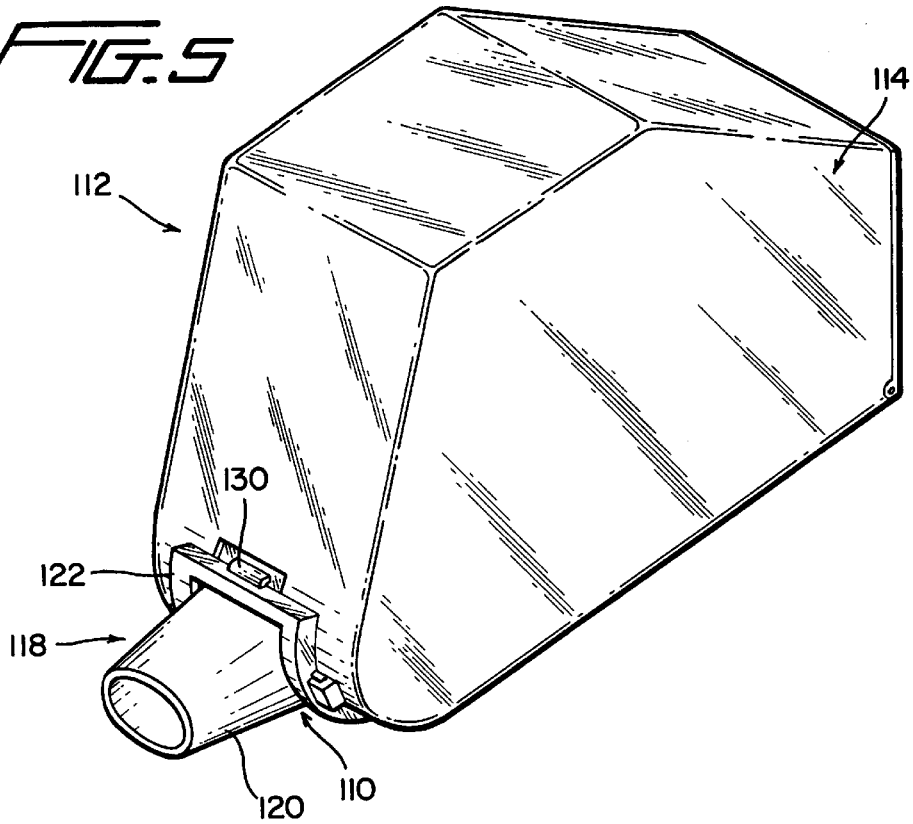
FIG. 5 is a perspective view of a dispensing mechanism employing the present flow regulator.
Figure 7:
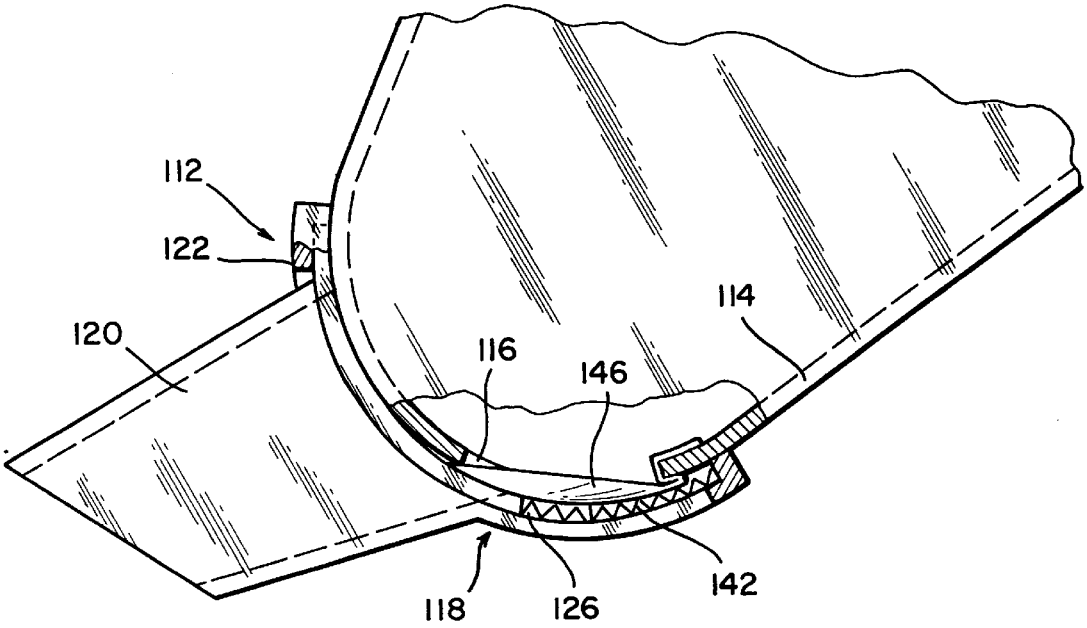
FIG. 7 is a partial cross sectional view showing the nozzle in its first position; and, FIG. 8–10 are partial cross sectional views showing the dispensing mechanism as it moves between a closed position and an open position.
Figure 6:
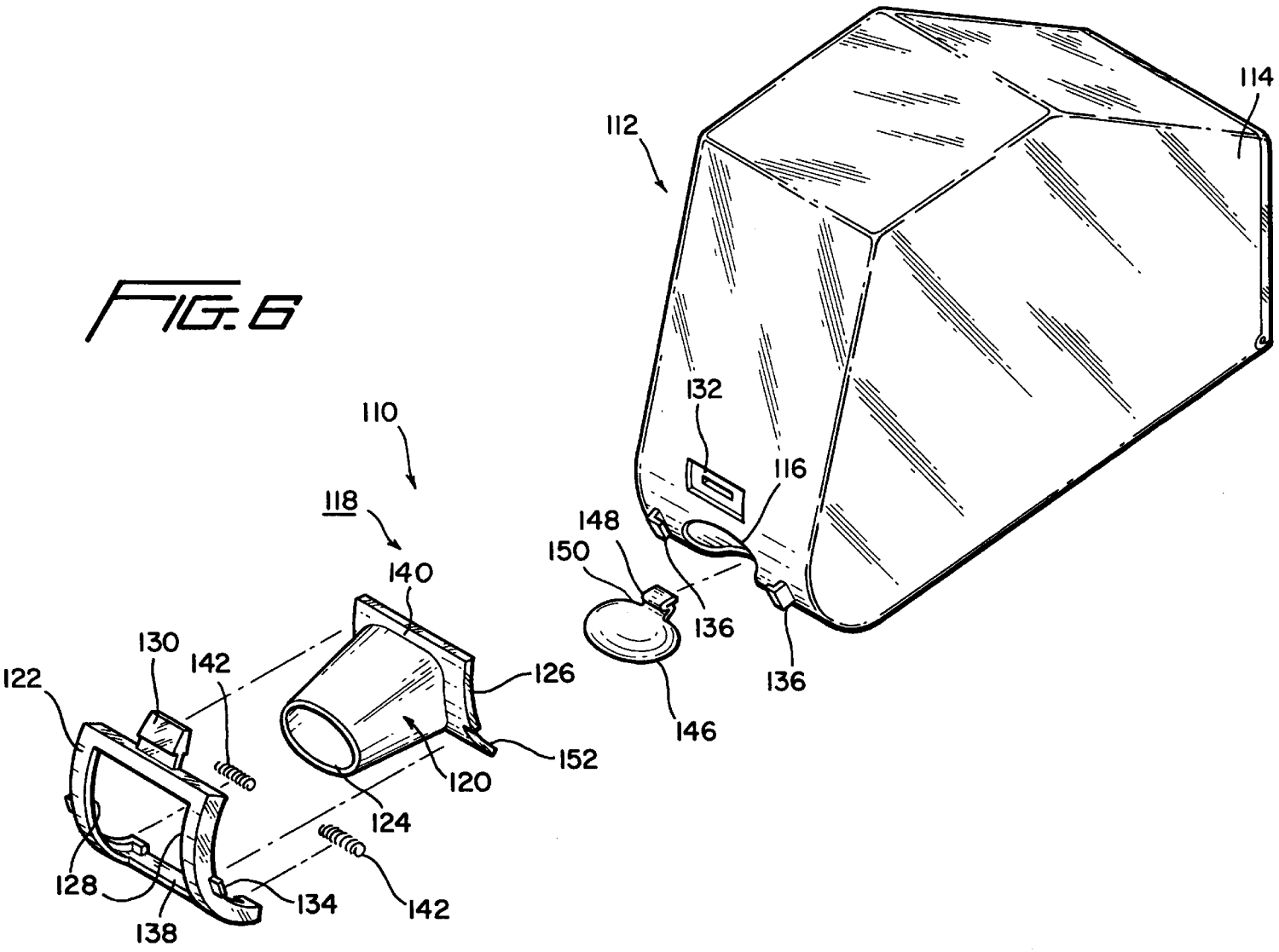
FIG. 6 is an exploded view of the dispensing mechanism.

With reference to FIGS. 1 through 3, a flow regulator 10 for the controlled dispensing of material stored within a container 12 is disclosed. The flow regulator 10 is designed to control the flow of material from a container outlet 14, by preventing the flow of material until the container outlet 14 and the inlet 16 of a material passageway 18 are substantially aligned. In this way, the flow regulator 10 prevents the inadvertent flow of material from the container 12 by only allowing material to exit the container 12 when the container outlet 14 and the inlet 16 of the material passageway 18 are substantially aligned.

The flow regulator 10 is adjacent the container outlet 14, and includes a material passageway 18 through which the material exiting the container outlet 14 flows and a regulating flap 20 coupled between the container outlet 14 and the inlet 16 of the material passageway 18. The material passageway 18 is mounted adjacent the container outlet 14 such that the inlet 16 of the material passageway 18 can be moved in and out of alignment with the container outlet 14. As those of ordinary skill in the art will appreciate, the material passageway 18 can be mounted in a wide variety of ways for movement relative to the container outlet 14, and a specific dispensing mechanism is disclosed below employing the unique flow regulator As disclosed below.

While the embodiment described herein relies upon movement of the material passageway to facilitate the alignment of the container and the material passageway, the present flow regulator could be employed in other systems where the container moves relative to the material passageway without departing from the spirit of the present invention.

Figure 4:
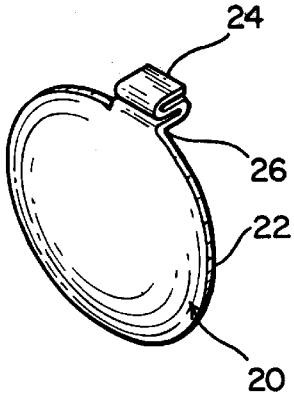
FIG. 4 is perspective view of the regulating flap.

As stated above, the regulating flap 20 is coupled between the container outlet 14 and the inlet 16 of the material passageway 18. In accordance with the disclosed embodiment, and As shown in FIG. 4, the regulating flap 20 includes a closure flap 22 shaped and dimensioned or configured to substantially cover the container outlet 14, a support arm 24 adapted for attachment to the container 12 adjacent the container outlet 14 such that the closure flap 22 is positioned to selectively cover the container outlet 14, and a hinge 26 positioned between the closure flap 22 and the support arm 24 such that the closure flap 22 can pivot relative to the support arm 24. The closure flap 22 should be shaped to cover the container outlet 14 in such a way that no product can move past the closure flap 22 when it is in its closed orientation. As such, the closure flap 22 can be shaped such that gaps exist between itself and the container outlet so long as the gaps are not larger than the product stored within the container 14. The support arm 24 is frictionally secured to the container 12 adjacent the container outlet 14 such that the closure flap 22 substantially covers the container outlet 14 as it pivots on the hinge 26 of the regulating flap 20, although other attachment structures could be employed without departing from the spirit of the present invention.

The regulating flap 20 prevents the flow of material between the container 12 and the material passageway 18 until such a time that the container outlet 14 and the inlet 16 of the material passageway 18 are substantially aligned. As such, the regulating flap 20 is sized and dimensioned or configured to substantially cover the container outlet 14 when the container outlet 14 and the inlet 16 of the material passageway 18 are out of alignment. In preventing the flow of material from the container outlet 14, the regulating flap 20 moves between a closed position blocking the flow of material from the container outlet 14 (see FIGS. 1 and 2) and an open position permitting the flow of material from the container outlet 14 (see FIG. 3). The movement of the regulating flap 20 between its closed position and its open position is controlled by a biasing member 28 on the upper surface 30 of the material passageway 18, adjacent the inlet 16 of the material passageway Specifically, and with reference to FIGS. 1 through 3, the biasing member 28 of the material passageway 18 contacts the closure flap 20 when the inlet 16 of the material passageway 18 is out of alignment with the container outlet 14. As the material passageway 18 is moved, and the inlet 16 comes closer to alignment with the container outlet 14, the biasing member 28 remains in contact with the closure flap 22 and prevents the regulating flap 20 from moving to its open position. Once the material passageway 18 is moved to a position where the inlet 16 of the material passageway 18 and the container outlet 14 are substantially aligned, the biasing member 28 no longer contacts the closure flap 22 and the regulating flap 20 is free to move to its open position. At this point, the material stored within the container 12 is free to move between the container 12 and the material passageway 18. The position at which the biasing member 28 releases the regulating flap 20 can be varied depending upon the size of the product being dispensed. As such, the container outlet 14 and the inlet 16 of the material passageway need only be substantially aligned before it is acceptable for the biasing member 28 to release the regulating flap 20.

When one wishes to stop the flow of material from the container outlet 14, the material passageway 18 need only be moved to a position where the container outlet 14 and the inlet 16 of the material passageway 18 are slightly out of alignment. As the container outlet 14 and inlet 16 of the material passageway 18 move out of alignment, the biasing member 28 contacts the closure flap 22 and forces the regulating flap 20 to its closed position. The closure flap 22 then stops the flow of material from the container outlet 14.

As discussed above, movement of the regulating flap 20, specifically, the closure flap 22 of the regulating flap 20, between its closed position and its open position is controlled by the biasing member 28. The upward force of the biasing member 28 maintains the closure flap 22 adjacent the container outlet 14 such that it substantially covers the outlet 14. When the biasing member 28 is no longer applying force to maintain the closure flap 22 in its closed position, the force of gravity and the material from the container outlet 14 cause the closure flap 22 to move to its open position.

The opening and closing of the closure flap 22 can be modified by providing a spring hinge which ensures that the closure flap 22 moves to an open position when the biasing member 28 is moved out of contact with the closure flap 22. The biasing member 28 can be configured such that a predetermined distance of movement is required in order to move out of contact with the closure flap 22. Alternately, movement of the closure flap 22 can be controlled by a hydraulic actuator, gear action, pneumatic activation, or other control system, without departing from the spirit of the present invention.

With reference to FIGS. 5 through 10, the flow regulator 110 described above is disclosed in a novel dispensing mechanism 112. The mechanism 112 includes a container 114, or bulk bin, having a container outlet 116 though which material passes to a nozzle assembly 118 for dispensing to a consumer.

The nozzle assembly 118 includes a sliding nozzle 120 and a nozzle retainer 122. Specifically, the nozzle 120 is provided with a spout 124 through which the material passes as it is dispensed to the consumer. The spout 124 is surrounded by a nozzle plate 126 which interacts with the nozzle retainer track 128 of the nozzle retainer 122 to support the nozzle 120 on the container 114.

The nozzle 120 is coupled to the container 114 by the nozzle retainer 122. The nozzle 120 and nozzle retainer 122 are affixed to the container 114 by inserting a sliding dart 130 along the upper edge of the nozzle retainer 122 into a dart receptacle 132 formed along the wall of the container 114, and coupling alignment lugs 134 on the nozzle retainer 122 to lug hooks 136 on the wall of the container 114.

When the nozzle 120 and nozzle retainer 122 are mounted on the container 114 adjacent the container outlet 116, the nozzle 120 is free to slide, preferably in an arcuate manner, along the nozzle retainer track 128 formed on the inner surface 138 of the nozzle retainer 122. In this way, the nozzle 120 and nozzle assembly 118, can move along the outer surface contour of the container between a first position in which the nozzle inlet 140 and the container outlet 116 are out of alignment (see FIG. 7) and a second position in which the nozzle inlet 140 and the container outlet 116 are in alignment (see FIG. 10). Movement of the nozzle 120 along the curved surface of the container 114 is enhanced by ensuring the center of radius on the curved surface of the container 114 is preferably identical to the center of radius of the nozzle plate 126, nozzle retainer 122 and nozzle retainer track 128. In this way, smooth arcuate movement of the nozzle 120 between its first position and its second position is ensured.

Since it is desirable to make certain that the nozzle assembly 118 is only open when a consumer desires to remove material from the container 114, the nozzle retainer 122 is provided with compression springs 142. The compression springs 142 act upon the nozzle plate 126 to force the nozzle 120 to its closed position when a consumer is not applying force to counter the bias imparted by the compression springs 142.

The controlled flow of material between the container outlet 116 and the nozzle inlet 140 is maintained by a regulating flap 144 positioned between the container outlet 116 and the nozzle 120. Specifically, the regulating flap 144 is substantially identical to the regulating flap 20 described above. As such, the regulating flap 144 includes a closure flap 146 configured to substantially cover the container outlet 116, a support arm 148 adapted for attachment to the container 114 adjacent the outlet 116 such that the closure flap 146 is positioned to selectively cover the container outlet 116, and a hinge 150 positioned between the closure flap 146 and the support arm 148 such that the closure flap 146 can pivot relative to the support arm 148.

The support arm 148 is preferably friction fit to the container 114 adjacent the container outlet 116 such that the closure flap 146 substantially covers the container outlet 116 as it pivots on the hinge 150 of the regulating flap 144. In accordance with this embodiment, the regulating flap 144 is preferably constructed from spring steel or stainless steel, having an inherent spring bias forcing the regulating flap 144 to move to its open position as will be discussed in greater detail below. While the regulating flap 144 is disclosed as being frictionally attached to the container 114, the regulating flap 144 can be coupled to the container 114 in a variety of ways, such as by adhesive, integral molding, riveting, or other methods of attachment without departing from the spirit of the present invention.

The regulating flap 144 prevents the flow of material between the container 114 and the nozzle 120 until the container outlet 116 and nozzle inlet 140 are substantially aligned. In preventing the flow of material from the container outlet 116, the regulating flap 144 moves between a closed position in which the flow of material from the container outlet 116 is blocked and an open position in which the flow of material from the container outlet 116 is unimpeded (see FIGS. 8 and 10, respectively). The movement of the regulating flap 144 between its closed position and its open position is controlled by the nozzle plate 126 which biases the regulating flap 144 to its closed position when the container outlet 116 and the nozzle inlet 140 are out of alignment.

Figure 8:
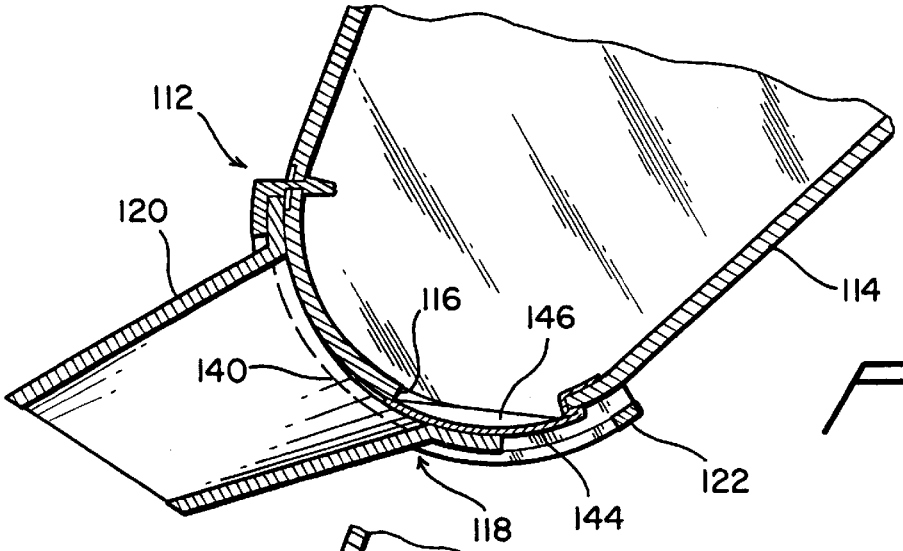
Figure 9:
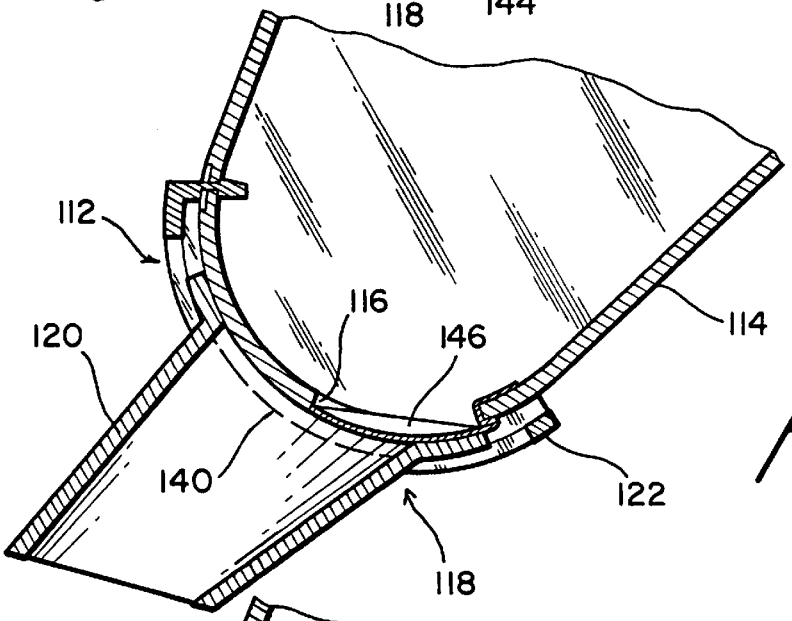
Figure 10:
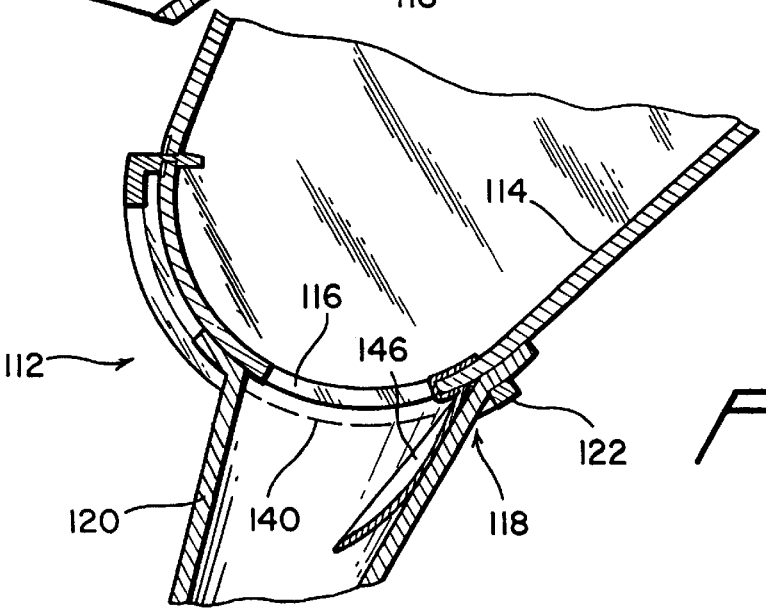

Specifically, and with reference to FIGS. 8 through 10, the nozzle plate 126 of the nozzle 120 contacts the closure flap 146 when the nozzle inlet 140 is out of alignment with the container outlet 116; that is, the nozzle 120 is in its first closed position. As the nozzle 120 is moved toward its second position, and the nozzle inlet 140 comes closer to alignment with the container outlet 116, the nozzle plate 126 remains in contact with the closure flap 146 and prevents the regulating flap 144 from moving to its open position, Once the nozzle 120 is moved to a position where the nozzle inlet 140 and the container outlet 116 are substantially aligned (that is, at, or slightly before, the nozzle's second position), the nozzle plate 126 no longer contacts the closure flap 146 and the regulating flap 144 is free to move to its open position. At this point, material is free to move between the container 114 and the nozzle 120. As stated above with reference to FIGS. 1 through 3, the regulating flap 146 moves to its open position just before the nozzle 120 moves completely to its second position with the container outlet 116 and nozzle inlet 140 in full alignment. For example, and in accordance with the preferred embodiment of the present dispensing mechanism 112, the regulating flap 146 is released by the nozzle plate 126 when the nozzle 120 has moved to about 90% of its second position. However, it should be understood that this predetermined release point can be varied depending upon the size and configuration of the product being dispensed or desired rate of initial flow.

The movement of the regulating flap 144 to its open position is enhanced by the spring forces of the regulating flap 144 which biases the regulating flap 144 to its open position. In addition, the contour of the closure flap 146 substantially matches the contour of the inner wall 152 of the nozzle 120, allowing the regulating flap 144 to completely deflect and lie flush with the inner wall 152 of the nozzle 120.

When one wishes to stop the flow of material from the container outlet 116, the applied pressure to the nozzle 120 is released and the compression springs 142 force the nozzle 120 back to its first closed position. As the nozzle 120 moves toward its first closed position, the nozzle plate 126 immediately biases the regulating flap 144 toward its closed position. In this way, the regulating flap 144 closes the flow of material between the container outlet 116 and the nozzle inlet 140 prior to the nozzle 120 achieving its fully closed position, thereby restricting the flow of product from the container outlet 116.

In addition, the invention has been described with the material passageway being moved to control the alignment of the container outlet with the inlet of the passageway. However, the present flow regulator could be employed in other systems where the container moves relative to the material passageway, without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A flow regulator for controlling the flow of material from a container, wherein the container includes a container outlet through which the material freely flows when the container outlet is not closed, comprising:

a material passageway including an inlet, wherein the inlet of the material passageway is moved relative to the container between a first position where the inlet of the material passageway is not aligned with the container outlet to prevent the free flow of material between the container and the material passageway and a second position where the inlet of the material passageway is aligned with the container outlet to permit the flow of material between the container and the material passageway;

a regulating flap, configured to substantially cover the container outlet, coupled between the container outlet and the inlet of the material passageway, the regulating flap being moved between a closed position where the flow of material from the container outlet is prevented when the container outlet and the inlet of the material passageway are out of alignment and an open position where the flow of material from the container outlet is permitted when the container outlet and the inlet of the material passageway are substantially aligned;

wherein movement of the material passageway relative to the regulating flap controls actuation of the regulating flap between an open and a closed position.

2. The flow regulator according to claim 1, wherein the material passageway includes a biasing member which restrains the regulating flap in its closed position when the container outlet is out of alignment with the inlet of the materials passageway and releases the regulating flap when the inlet of the material passageway is substantially aligned with the container outlet.

3. The flow regulator according to claim 1, wherein the regulating flap is resiliently biased.

4. The flow regulator according to claim 3, wherein the material passageway includes a biasing member which restrains the regulating flap in its closed position when the outlet of the container is out of alignment with the outlet of the container.

5. The flow regulator according to claim 3, wherein the regulating flap includes a closure flap configured to substantially cover the outlet of the container, a support arm adapted for attachment to the container adjacent the outlet such that the closure flap is positioned to selectively cover the outlet of the container, and a hinge positioned between the closure flap and the support arm such that the closure flap can pivot relative to the support arm.

6. The flow regulator according to claim 1, wherein the regulating flap includes a closure flap configured to substantially cover the outlet of the container, a support arm adapted for attachment to the container adjacent the outlet such that the closure flap is positioned to selectively cover the outlet of the container, and a hinge positioned between the closure flap and the support arm such that the closure flap can pivot relative to the support arm.

7. A dispensing mechanism for the controlled dispensing of material stored within a container, comprising:

a nozzle adapted for attachment to a container outlet, the nozzle including a nozzle inlet into which the material from the container can flow and a nozzle outlet through which material entering the nozzle can exit;

a nozzle bracket for mounting the nozzle adjacent the container outlet, the nozzle bracket supporting the nozzle along the outer surface contour of the container such that the nozzle can be moved arcuately between a first position in the nozzle inlet is not aligned with the container outlet and a second position in which the nozzle inlet is aligned with the container outlet;

a regulating flap coupled between the container outlet and the nozzle inlet, the regulating flap being configuered to substantially cover the container outlet, wherein the regulating flap is in a closed position preventing material from passing out of the container outlet when the container outlet and the nozzle inlet are not aligned and the regulating flap is in an open position permitting the flow of material out of the container outlet when the container outlet and the nozzle inlet are substantially aligned.

8. The dispensing mechanism according to claim 7, wherein the nozzle bracket includes a spring which resiliently biases the nozzle to a closed postion.

9. The dispensing mechanism according to claim 7, wherein the nozzle includes a nozzle plate which restrains the regulating flap in its closed position when the container outlet is out of alignment with the nozzle inlet and releases the regulating flap when the nozzle inlet is substantially aligned with the container outlet.

10. The dispensing mechanism according to claim 7, wherein the regulating flap includes a closure flap configured to substantially cover the outlet of the container, a support arm adapted for attachment to the container adjacent the outlet such that the closure flap is positioned to selectively cover the outlet of the container, and a hinge positioned between the closure flap and the support arm such that the closure flap can pivot relative to the support arm.

11. The dispensing mechanism according to claim 7, wherein the regulating flap is resiliently biased.

12. The dispensing mechanism according to claim 7, wherein the nozzle bracket selectively mounts the nozzle to the container.

13. A dispensing container providing for the controlled dispensing of material stored within the container, comprising:

a container having a container outlet through which material stored within the container can be dispensed;

a nozzle attached to the container adjacent the container outlet, the nozzle including a nozzle inlet into which the material from the container can flow and a nozzle outlet through which material entering the nozzle can exit, wherein the nozzle is coupled to the container such that the nozzle can be moved between a first position in which the nozzle inlet is not aligned with the container outlet and a second position in which the nozzle inlet is aligned with the container outlet;

a regulating flap coupled between the container outlet and the nozzle inlet, the regulating flap being configured to substantially cover the container outlet, wherein the regulating flap is in a closed position preventing material from passing out of the container outlet when the container outlet and the nozzle inlet are not aligned and the regulating flap is in an open position permitting the flow of material out of the container outlet when the container outlet and the nozzle inlet are substantially aligned.

14. The dispensing container according to claim 13, wherein the nozzle includes a nozzle plate which restrains the regulating flap in its closed position when the container outlet is out of alignment with the nozzle inlet and releases the regulating flap when the nozzle inlet is substantially aligned with the container outlet.

15. The dispensing container according to claim 13, wherein the regulating flap includes a closure flap configured to substantially cover the outlet of the container, a support arm adapted for attachment to the container adjacent the outlet such that the closure flap is positioned to selectively cover the outlet of the container, and a hinge positioned between the closure flap and the support arm such that the closure flap can pivot relative to the support arm.

16. The dispensing container according to claim 13, wherein the regulating flap is resiliently biased.

17. The dispensing container according to claim 13, further including a nozzle bracket mounting the nozzle adjacent the container outlet, the nozzle bracket supports the nozzle such that the nozzle can be moved between a first position in which the nozzle inlet is aligned with the container outlet and a second position in which the nozzle inlet is not aligned with the container outlet.

18. The dispensing container according to claim 17, wherein the mounting bracket includes a spring which resiliently biases the nozzle to a closed position.

* * * * *

UNITED STATES PATENT AND TRADEMARK OFFICE

CERTIFICATE OF CORRECTION

PATENT NO. : 5,979,717
DATED : November 9, 1999
INVENTOR(S) : David Andrew Dalton et al.

It is certified that error appears in the above-identified patent and that said Letters Patent is hereby corrected as shown below:

Claim 7,
Line 5, please delete "in the"and insert therefore -- in which the --.
Line 65, please delete "a container outlet" and insert therefore -- a container adjacent a container outlet --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*